US005581835A

United States Patent [19]

Herbertz

[11] Patent Number: 5,581,835

[45] Date of Patent: Dec. 10, 1996

[54] METHOD AND MACHINE FOR CLEANING GARMENTS

[76] Inventor: Heinz Herbertz, Theodor-Heuss-Weg 31, 42579 Heiligenhaus, Germany

[21] Appl. No.: 354,826

[22] Filed: Dec. 8, 1994

[30] Foreign Application Priority Data

Dec. 9, 1993 [DE] Germany ..... 43 42 008.7

[51] Int. Cl.[6] ..... D06B 23/04

[52] U.S. Cl. ..... 8/150; 68/23 R; 68/186; 68/187; 68/194; 68/157; 68/24; 68/23.5

[58] Field of Search ..... 8/150, 150.5; 68/7, 68/5 B, 8, 186, 187, 194, 199, 157, 23 R, 24, 23.5; 69/30, 31, 32

[56] References Cited

U.S. PATENT DOCUMENTS

| | | | |
|---|---|---|---|
| 685,552 | 10/1901 | Adams, Jr. | 68/157 |
| 839,470 | 12/1906 | Glasel | 8/150.5 |
| 931,858 | 8/1909 | Glasel | 69/30 |
| 970,701 | 9/1910 | Glasel | 69/30 |
| 1,414,404 | 5/1922 | Glasel | 8/150.5 |
| 1,501,471 | 7/1924 | Smith | 68/157 |
| 1,945,444 | 1/1934 | Rutherford | 68/157 |
| 1,998,567 | 4/1935 | Wayland | 8/150.5 |
| 4,986,094 | 1/1991 | Umino et al. | 68/199 |

FOREIGN PATENT DOCUMENTS

| | | | |
|---|---|---|---|
| 18332 | of 1887 | United Kingdom | 8/150.5 |

OTHER PUBLICATIONS

"Ein Mittelding zwischen der Wäsche und der Chemischreinigung", Reiniger & Wäscher, XLV, Heft/92, pp. 26–27.

*Primary Examiner*—Frankie L. Stinson
*Attorney, Agent, or Firm*—Wigman, Cohen, Leitner & Myers, P.C.

[57] ABSTRACT

A method for cleaning garments. The garments are spread out in the interior of a cylinder (1) of a cleaning machine, attached there with bands (7) and hangers (10) and cleaned in this manner. By the method shrinkage and wrinkles will be avoided. Spin drying following cleaning and rinsing can be carried out at high speed, because the centrifugal forces act on garments which are spread out and lying flat and hence the forces do not create unwanted creases and wrinkles. The cleaning and spin drying will be followed by drying the spread out and attached garments by supply of heat. An ironing effect is improved by an intermediate spin speed. This method is suitable especially for cleaning in aqueous solutions. The garments are attached to the interior of the cylinder (1) by bands (7) with loops (8) connected to hooks (5). The solvents used for cleaning enter through the aqueous duct (11) and the hot air for drying enters through air duct (12).

15 Claims, 2 Drawing Sheets

FIG. 2
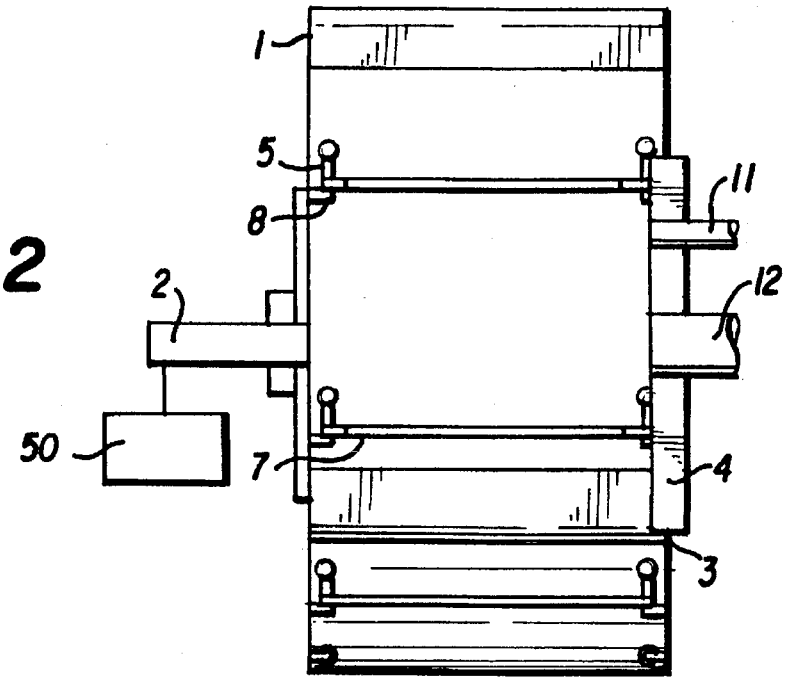
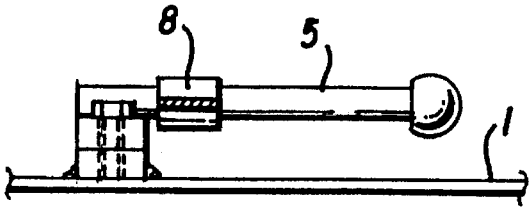
FIG. 4
FIG. 5
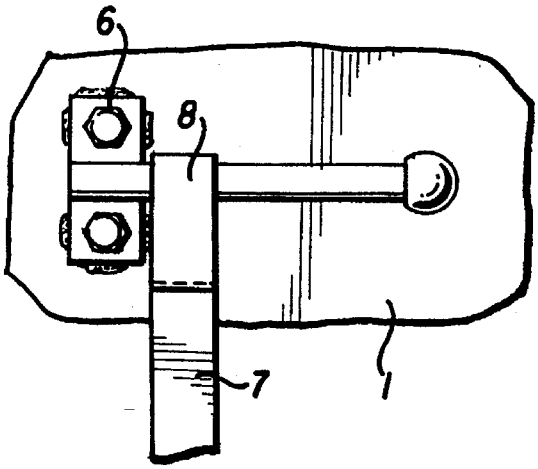

METHOD AND MACHINE FOR CLEANING GARMENTS

BACKGROUND OF THE INVENTION

The invention relates to a method and a machine for cleaning garments. Presently, garments are predominantly cleaned by solvents such as perchlorethene. These solvents have advantageous physical properties, such as high density, a low evaporation point, they need little thermal energy for evaporation and the cleaning procedure does not cause much shrinkage and wrinkles in the garments. However, disadvantageously, these chemicals are toxic and dangerous for the environment and various regulatory authorities put restrictions on their use. This results in machines and cleaning procedures becoming expensive. Solvents without chlorine are regarded as less toxic, but are highly inflammable and may cause explosions. Therefore, cleaning of garments in aqueous solvents is of growing importance.

Most garments can be cleaned in an aqueous solution, but the procedure of tumble action washing and spin drying in a usual machine causes shrinkage and wrinkles and the evaporation of water consumes more than six times the amount of heat consumed in evaporating perchlorethene.

DESCRIPTION OF THE PRIOR ART

A method for cleaning garments by an aqueous wash cycle is described in a trade journal article (Reiniger + W äscher, XLV, Number 2/92 page 26 and 27, Verlag Neuer Merkur GmbH, Munich, Germany). To avoid shrinkage and wrinkles, this method proposes to reduce the movement of the cylinder of the cleaning machine. Instead of rotating, the cylinder swings over a 270 degree arc and stands still for a long time.

The mixing rate of the machine described in the trade journal article is reduced and therefore a longer time is needed for the procedure. To avoid wrinkles in the garments, it is necessary to carry out spin drying at a low speed and therefore a greater amount of heat is necessary for the drying by evaporation, as more water must be evaporated.

SUMMARY OF THE INVENTION

It is the object of the present invention to provide an improved method and machine for cleaning garments. This object is accomplished by the present invention by spreading the garments and attaching them to the inner side of the cylinder of the cleaning machine and cleaning and spin drying the garments in this manner.

In an advantageous further aspect of the invention, the garments will stay spread out after spin drying, kept attached to the inner side of the cylinder and dried by heat supplied to the cylinder.

The advantages given by the invention consists mainly in avoiding shrinkage and wrinkles in the garments, without reducing the movements of the cylinder, by which the highest possible mixing rate will be achieved. Most of all, the method according to the invention makes spin drying at high speed possible, without causing shrinkage and wrinkles in the garments. As a result, the amount of heat necessary to evaporate the aqueous solvents will be reduced considerably because a greater amount of water is removed during the spin drying cycle.

An advantageous further aspect of the invention makes it possible to dry and finish the garments in the cylinder of the machine.

A further aspect provides an intermediate spin speed during, and/or after the drying process. Even an ironing effect in a cleaning machine can be achieved by this aspect.

In case the garments are to be cleaned in more than one layer, sheets of a textile material are spread between the layers. This avoids the transfer of colors and lint from one garment to another. Sheets preferably of synthetic (man-made) fibers are used to provide reduced moisture retention.

To shorten the times of loading and unloading, the garments can be attached to a package or liner outside of the machine and the package or liner attached inside the cylinder.

A number of different attachments can be used, including buttons, press studs, snap fasteners, and Klett-fasteners. In addition, simple devices can be used for attaching the garments into the cylinder of the machine, including bands consisting of elastic material, loops and hooks to fasten them.

To provide for an equal distribution on the garments, both the aqueous solvent and the hot air for drying are preferably conducted through the central cover of the turning cylinder.

With the foregoing and other objects, advantages and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWINGS

A preferred embodiment of the invention is shown in the drawings.

FIG. 2 is an elevational section of the cylinder with the cover;

FIG. 4 is an elevational view of a hook and shows its attachment to the cylinder; and FIG. 5 is a plan view of a hook with a band and loop.

DETAILED DESCRIPTION OF THE INVENTION

Figure 1:
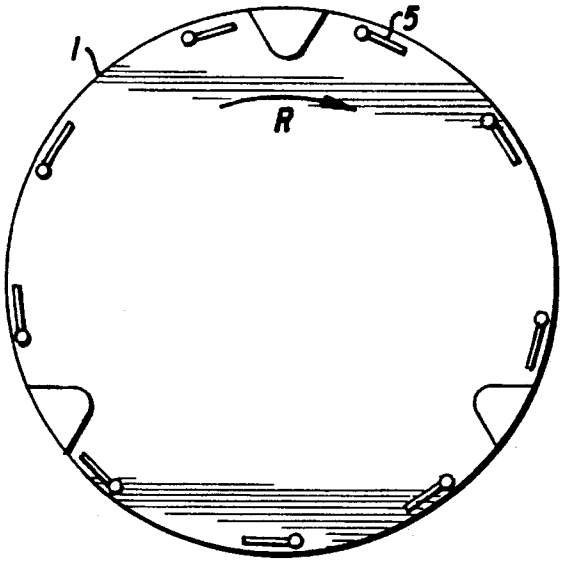
FIG. 1 is a cross section of the cylinder of the machine with hook fasteners.
Figure 3:
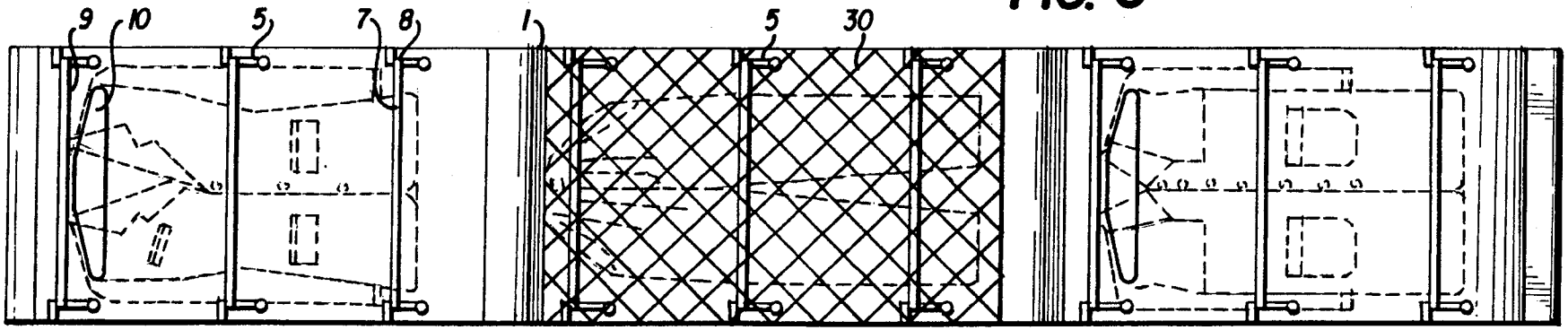
FIG. 3 shows the cylinder opened and unrolled with garments mounted thereon shown in phantom.

Referring now to the drawings, wherein like elements are designated by like reference numerals, a rotatable or centrifugal cylinder 1 has an axle 2 for bearing at one side and an opening 3 for loading at the opposite side, which can be closed by a cover 4. The hooks 5 to which the bands 7 are attached by loops 8, are fixed to the cylinder 1 by screws 6. The bands 9 are attached to hangers 10. Aqueous solvent duct 11 and the air duct 12 are connected with cover 4. A covering screen 30 (FIG. 3) can be used to attach one or more layers of garments and/or intermediate textile sheets. The cylinder 1 is rotated by a washing machine motor 50, as known in the art.

After opening the cover 4, the garments (shown in phantom) will be spread on the bottom of the cylinder, the bands 7 put on the garments an the loops 8 taken up by the hooks 5. Jackets and overcoats can be put on hangers 10, which can be attached also to the cylinder 1 by means of bands 9, which also own loops 8 for connecting with the hooks 5. The cylinder 1 will preferably turn in a direction that causes pulling of the garments by the hangers 10. The loading will be made easier by a device for moving the cylinder incrementally, as known in the art, which may form part of motor 50.

To enlarge the capacity of the machine, the garments can be attached in a number of layers, one upon the other.

After loading the garments in the cylinder the aqueous solvent with the necessary detergents enters into the cylinder 1, which rotates in the direction of the arrow R, through the aqueous duct 11. The rinsing is carried out thereafter in the same manner, followed by a spin drying at high speed.

The centrifugal forces do not create unwanted wrinkles, because the garments lay flat in the position for ironing.

Following washing, rinsing and spin drying, hot air for drying the garments enters into the cylinder 1 through the air duct 12.

During and/or after the drying cycle, the cylinder 1 accelerates to a speed multiple to the cleaning speed and by this the desired ironing effect can be achieved.

Although a certain presently preferred embodiment of the invention has been described herein, it will be apparent to those skilled in the art to which the invention pertains that variations and modifications of the described embodiment may be made without departing from the spirit and scope of the invention. Accordingly, it is intended that the invention be limited only to the extent required by theh appended claims and the applicable rules of law.

I claim:

1. Method for cleaning garments in a centrifugal cleaning machine having a rotatable cylinder, comprising the steps of spreading the garments out in one or more layers, attaching the garments to the interior of the cylinder, cleaning the garments by supplying an aqueous solvent to said cylinder while moving the cylinder, rinsing the garments, and spin drying the garments by spinning said cylinder.

2. Method according to claim 1, further comprising the step of drying the garments by supplying heat while the garments are spread out and attached to the interior of the cylinder.

3. Method according to claim 2, further comprising the step of spinning at an intermediate spin speed while supplying heat.

4. Method according to claim 3, further comprising the steps of attaching the garments to the sheets of textile material outside of the cleaning machine, loading the garments and sheets together and attaching the garments and sheets to the interior of the cylinder.

5. Method according to claim 2, further comprising the step of spinning at an intermediate spin speed after supplying heat.

6. Method according to claim 1, further comprising the step of spinning at an intermediate spin speed while supplying heat.

7. Method according to claim 1, further comprising the step of spinning at an intermediate spin speed after supplying heat.

8. Method according to claim 1, wherein the garments are cleaned in a number of layers and wherein sheets of permeable textile material are spread out between the layers.

9. Method according to claim 1, further comprising the steps of attaching the garments to the sheets of textile material outside of the cleaning machine, loading the garments and sheets together and attaching the garments and sheets to the interior or the cylinder.

10. A machine for cleaning garments comprising:

a cylinder having an inner surface for holding garments, means for attaching the garments to the cylinder inner surface, means for supplying an aqueous solvent to said cylinder, means for rotating said cylinder while said aqueous solvent is supplied to said cylinder, means for spinning said cylinder to remove the aqueous solvent from said garments in said cylinder.

11. Machine according to claim 10, wherein the garments are attached by bands made of elastic material.

12. Machine according to claim 11, wherein the bands have loops to connect them to hooks, which are fixed to the cylinder.

13. Machine according to claim 10, wherein hangers are attached to the cylinder.

14. Machine according to claim 10, wherein the cylinder of the cleaning machine is closed by a cover, equipped with an aqueous duct and an air duct.

15. Machine according to claim 10, further comprising means for rotating the cylinder incrementally.

* * * * *